United States Patent [19]

Carlström et al.

[11] 4,317,314

[45] Mar. 2, 1982

[54] SURFACE FINISHING MACHINE

[75] Inventors: Per Carlström, Karlskrona; Gert Persson, Lyckeby, both of Sweden

[73] Assignee: Dynapac Maskin AB, Solna, Sweden

[21] Appl. No.: 149,474

[22] Filed: May 13, 1980

[30] Foreign Application Priority Data

May 17, 1979 [SE] Sweden ..... 7904336

[51] Int. Cl.[3] ..... B24B 23/02

[52] U.S. Cl. ..... 51/177

[58] Field of Search ..... 51/170-177, 51/99, 126; 15/49 R

[56] References Cited

U.S. PATENT DOCUMENTS

| | | | |
|---|---|---|---|
| 864,403 | 8/1907 | Beck | 51/177 |
| 2,811,874 | 11/1957 | Rethoret | 51/99 |
| 3,124,911 | 3/1964 | Vinella | 51/177 |
| 3,522,679 | 8/1970 | Sundberg | 51/177 |
| 3,934,377 | 1/1976 | Tertinek | 51/177 |

FOREIGN PATENT DOCUMENTS

| | | | |
|---|---|---|---|
| 497380 | 5/1930 | Fed. Rep. of Germany | 51/77 |
| 1529847 | 5/1968 | France . | |
| 301388 | 11/1954 | Switzerland . | |

*Primary Examiner*—Harold D. Whitehead

*Attorney, Agent, or Firm*—Brumbaugh, Graves, Donohue & Raymond

[57] ABSTRACT

A machine for finishing a flat surface, for example a floor made of cement, concrete, or similar hardened material, includes a chassis supported by at least three wheels arranged to carry the weight of the chassis. A grinding tool, preferably a grinding wheel, is mounted to the chassis to rotate about a vertical rotational axis and to rest on the floor when grinding work is in progress. The grinding wheel is mounted to move freely in the vertical direction relative to the chassis such that the weight of the grinding wheel is carried by the floor, and the grinding pressure is readily adjustable for differing applications.

13 Claims, 3 Drawing Figures

SURFACE FINISHING MACHINE

BACKGROUND OF THE INVENTION

The present invention relates to a machine for finishing flat surfaces such as concrete or cement floors, or floors of similar hardened materials.

Known concrete finishing machines as a rule are equipped with a circular grinding wheel having an axis of rotation perpendicular to the surface to be finished (i.e. so that the grinding wheel lies flat on the floor), and a pair of running wheels. The weight of the machine is carried by the two running wheels and the flat floor-abutting surface of the grinding wheel. The grinding wheel rotates against the floor during machine operation, and the portion of the machine weight over the grinding wheel supplies the necessary downward pressure to finish the surface. However, since the grinding wheel rotates, torque is generated by the grinding wheel due to its frictional contact with the concrete surface, which torque must be absorbed by the operator of the machine to keep the machine steady.

Thus, in known grinding machines, since the grinding wheel itself acts as the third support point, in conjunction with the two running wheels, for supporting the weight of the machine, the torque generated by the grinding wheel has to be absorbed by the operator. On small grinding machines, with low grinding pressure, these forces may be small and considered a minor inconvenience to the operator. In larger machines, however, but also even on small machines when operated over lengthy periods of time, these forces constitute a major ergonomic inconvenience.

In order to counteract to some extent this inconvenience, which makes the machine more difficult to handle and maneuver, some machines are equipped with two counter-rotating grinding wheels. However, under some conditions, for example irregularities in the floor, the torque generated by the grinding wheels is not fully counterbalanced and thus not entirely eliminated. In addition, the use of double grinding wheels renders the machine heavy and difficult to maneuver.

Grinding machines, either having a single grinding wheel or a pair of counter-rotating grinding wheels, normally lack any means of regulating the pressure of the grinding wheels on the underlying surface, which limits the use to which a machine can be put to one particular type of grinding work.

SUMMARY OF THE INVENTION

The present invention is a grinding machine for finishing floors made of concrete, cement, or similar hardened materials. The machine includes a chassis supported on three or more wheels and one or more grinding wheels, arranged on vertical rotational shafts, which rest on the floor when grinding is in progress. The three support wheels for the chassis rest on the surface to be treated while grinding is in progress and support the weight of the chassis. One of the wheels is pivotable on a vertical steering shaft for maneuvering the machine. The chassis also includes an engine or motor, for rotating the grinding wheel, and a steering device.

The grinding wheel or wheels are carried by grinding heads arranged on the vertical shafts which are rotatable in a bearing housing. The bearing housing is mounted to the chassis to be free to move vertically relative to the chassis. The pressure of the grinding wheels against the underlying surface is adjustable using a hydraulic mechanism or separate loading weights. The weight of the chassis, which is carried by the three wheels (and not the grinding wheel) is chosen such that the supporting wheels are loaded down against the floor surface with sufficient weight to prevent slipping due to the grinding wheel rotation, that is, such that the frictional force between the wheels and the floor exceeds the torque generated by the rotating wheels grinding the floor. Thus, the torque generated by the grinding wheels is absorbed by the machine and not by the operator.

For a better understanding of the invention, reference is made to the following detailed description of the preferred embodiments, taken in conjunction with the drawings accompanying the application.

DETAILED DESCRIPTION OF A PREFERRED EMBODIMENT

Figure 1:
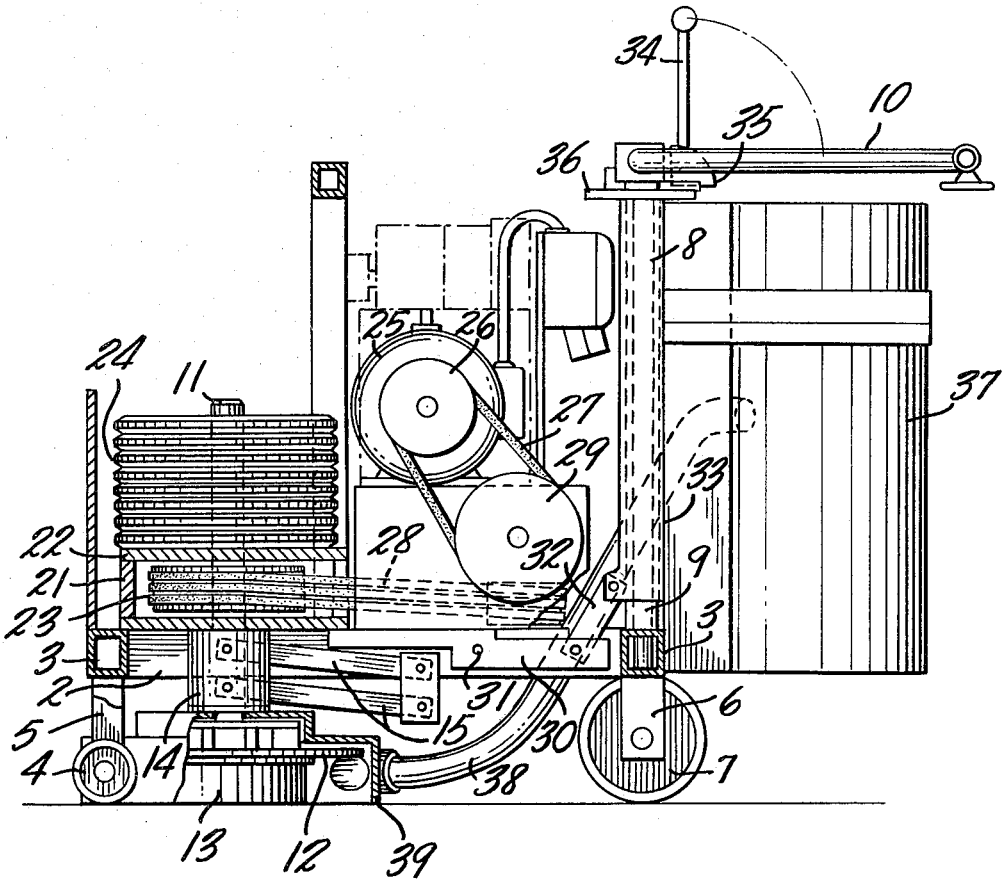
FIG. 1 is a vertical sectional view through an embodiment of the invention.
Figure 2:
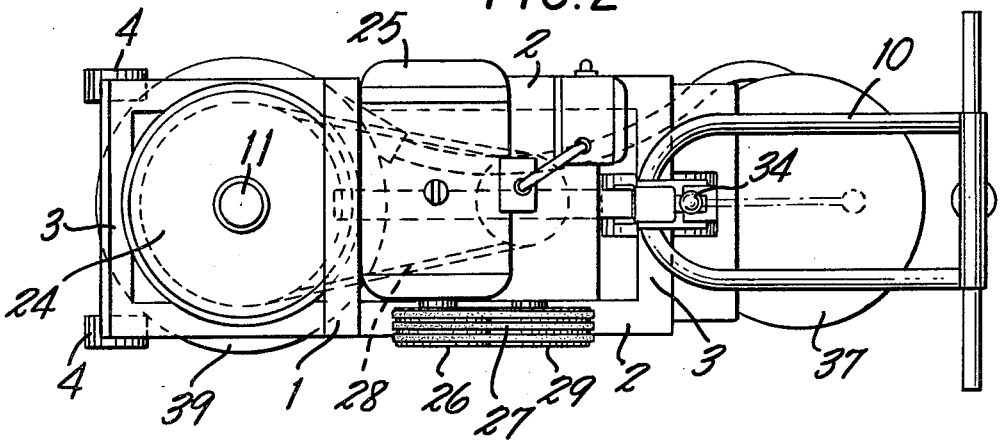
FIG. 2 is a top view of the device shown in FIG. 1.

A grinding machine in accordance with the invention includes a chassis 1 equipped with three running wheels 4 and 7 and built up on two longitudinal and two transverse, parallel beams 2 and 3, respectively. The forward portion of the chassis 1 is supported by two parallel wheels 4, each of which is journalled in a vertical bearing beam 5 attached to the front transverse beam 3 so as not to be pivotable about a vertical axis. The aft portion of the chassis 1 is supported by a steering wheel 7 journalled in a swivel fork 6. The swivel fork 6 is attached to a vertical steering shaft 8 which is disposed in and pivotable in a steering tube 9 vertically mounted on the aft transverse beam 3. The machine is maneuverable and steered by a handle 10 attached to the upper end of the steering shaft 8 and thereby connected to the swivel fork 6.

A vertical, rotatable shaft 11 is disposed in the forward portion of the chassis between the two longitudinal beams 2, so as to extend through the longitudinal axis of the machine. The vertical shaft 11 is fitted at its lower end with a grinding head 12, which in turn carries a cylindrical, horizontally-oriented grinding wheel 13. The shaft 11 is journalled in a bearing housing 14 which is supported by a linkage of two parallel bars 15 pivotably mounted between the bearing housing 14 and the two longitudinally extending beams 2 of the chassis. As mounted, the bearing housing 14 is free to move vertically relative to the chassis (so that the combined weight of the housing 14, grinding wheel 13, and weights 24 (described further on) rests on the floor), and constrained by the bars 15 from movement horizontally relative to the chassis 1.

Figure 3:
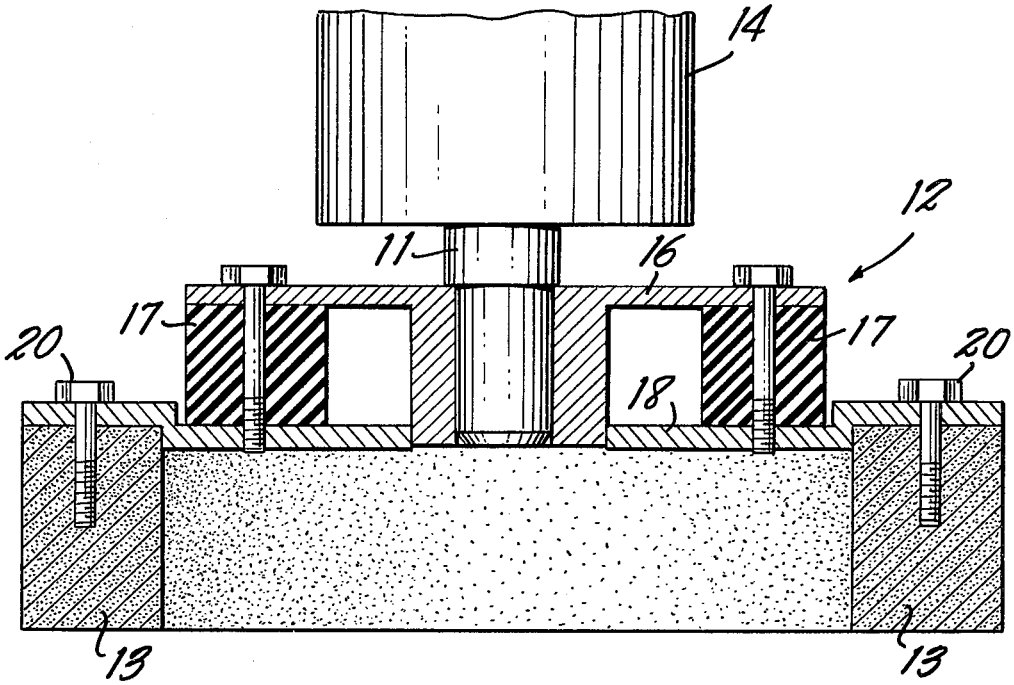
FIG. 3 is a vertical sectional view, on a larger scale, of a grinding head and grinding wheel in accordance with the invention.

Referring in particular to FIG. 3, the grinding head 12, which is mounted on shaft 11, includes a hub plate 16 which is resiliently connected, by a number of rubber elements 17, to a tool plate 18 which acts as a holder for the grinding wheel 13. The tool plate 18 is centered on a cylindrical portion of the round hub plate 16, and receives a plurality of screws 20 for attaching the grinding wheel 13. As shown in FIG. 3, a plurality of bolts extend through openings in the hub plate 16, through the rubber spacers 17, and are screwed into the tool plate 18. Bending forces on the tool plate 18 may thereby be absorbed in the hub plate 16 due to the fact that the tool plate 18 is free to twist toward the hub plate 16 against the compression force of the rubber elements 17.

A weight support frame 21, which includes a yoke 22, is attached to the upper portion of the bearing housing 14. The frame 21 encases a pulley 23 secured to the shaft 11. A plurality of weights 24 may be placed on the yoke 22, to be carried concentrically with shaft 11, the number of weights chosen corresponding to the grinding pressure desired for the particular application to which the machine is to be applied. The weights may be added or removed, as desired, for various applications and finishing requirements.

Shaft 11 is driven by a motor or an engine 25 mounted on the chassis 1. A pulley 26 mounted on the engine output shaft is connected by V-belt 27, pulley gear 29 and belts 28 to the pulley 23 mounted on the shaft 11. Thus, rotation of the motor output shaft, driving the V-belt transmission 27, 28, 29 and 30 causes rotation of the shaft 11 and thereby the grinding head 12 and grinding wheel 13.

The grinding head 12 may be moved vertically up and down by a lever 30 which is pivoted on a horizontal pivot shaft 31 carried by the longitudinal beams 2. The front end of the lever 30 engages the support frame 21 carrying the weights 24 and the rear end is coupled via a link 32 with a vertically moveable regulating tube 33 disposed around the steering tube 9 and vertically displaceable relative to the steering tube 9. A control lever 34 pivots on a horizontal shaft on handle 10, and through an eccentric 35 at its lower end engages a horizontal disk 36 attached on the upper end of the tube 33. Raising and lowering of the grinding wheel 13 between the grinding position (resting on the surface) and a position removed from the floor surface is controlled by the operator by raising and lowering the control lever 34, which may be done conveniently with one hand while steering (handle 10) with the other.

When the control lever 34 is pulled down into a horizontal position, the eccentric 35 depresses the tube 33 and lever 30 raises the grinding wheel 13 and supporting weights 24 away from the floor surface. The eccentric 35 of the control lever is designed so that when the lever 34 is moved to the vertical position, the eccentric 35 moves free of the plate 36, and the tube 33 is free to move up the steering tube 9 to the point where the grinding wheel 13 rests entirely on the floor (the weight of the grinding wheel and supplementary weights pushing the tube 33 upward). Disk 36 on the tube 33 is vertically adjustable to compensate for wear in the grinding wheel, to permit the play between disk 36 and eccentric 35 to be reduced to the minimum necessary to permit the grinding wheel 13 to be fully resting on the underlying floor surface under full pressure when the lever 34 is moved to the grinding position.

A substantial amount of dust is normally produced during grinding operations by the material that is ground away. To remove the dust and avoid injury to the operator, the machine may be fitted with vacuum cleaner equipment. A vacuum cleaner 37 is mounted on the frame and includes a hose 38 communicating with a cover 39 fitted around the grinding head 12 and mounted on bearing housing 14.

Resilient mounting of the grinding wheel relative to the chassis, for example using resilient supports 17, facilitates the effectiveness of the grinding machine. For example, when used on uneven surfaces, the three supporting wheels 4 and 7 for the chassis 1, if on an uneven portion of the floor, may support the grinding wheel shaft 11 at an attitude other than vertical relative to the floor directly under the grinding wheel 13 (since the bearing support 14 is suspended by parallel bars 15 levelled with the points of contact of the wheel pair 4). However, since the grinding wheel 13 is resiliently suspended, the grinding wheel 13 can compensate for the surface irregularity and assume a flat position on the floor. It is also possible for the grinding wheel to enter the grinding groove in all directions.

On machines designed for large grinding capacity, it is also advantageous for the grinding wheel to be resiliently mounted, since gentle starting of the grinding process therefore results, which spares the grinding tool particularly if it consists of diamond wheels. Vibrationless running also results, which facilitates grinding work, reduces the noise level and tool wear of the machine, and also produces a better surface.

The invention has been shown and described with reference to a preferred embodiment thereof. Variations and modifications of the invention will be apparent to persons skilled in the art without departing from the inventive concepts disclosed herein. For example, while the chassis has been shown having a three wheel suspension, more than three wheels, for example a four wheel suspension, may be used if desired. All such modifications and variations are intended to be within the scope of the present invention as defined in the following claims.

We claim:

1. A machine for finishing a flat surface, for example a floor made of cement, concrete, or similar hardened material, comprising a chassis, means for supporting said chassis on said flat surface including at least three spaced wheels arranged to carry the weight of said chassis, a grinding tool, and means for mounting said tool to said chassis for rotation in a plane parallel to said flat surface about a vertical rotational axis and for resting said tool on said flat surface when grinding work is in progress, wherein the weight of said tool is carried by said surface and wherein the mounting means for said tool comprises a rotational shaft arranged in said vertical rotational axis, a grinding head arranged on said rotational shaft and attached to said tool, bearing means on said rotational shaft for permitting rotation of said rotational shaft and thereby said grinding head and tool about said vertical rotational axis, means for attaching said bearing means to said chassis for permitting vertical movement of said bearing means and thereby said grinding head and tool relative to said chassis, and means for supporting weights on said tool for adjusting the downward pressure of said tool against said surface independent of said chassis, wherein two of said wheels are parallel and fixed about a vertical axis such that the weight of the chassis acting on said non-pivotable wheels counteracts the torque generated by the rotating tool.

2. A machine as defined in claim 1, comprising means for resiliently mounting said tool to said grinding head.

3. A machine as defined in claim 1, wherein said machine has a longitudinal axis and said two fixed wheels are arranged laterally spaced apart relative to said longitudinal axis, and wherein said rotational shaft extends through said longitudinal axis.

4. A machine as defined in claim 1, wherein said grinding tool comprises a grinding wheel and said grinding head comprises a hub plate attached to said rotational shaft, a tool plate attached to said grinding wheel and fitted concentrically around the hub plate, and resilient attachment means between said tool plate and said hub plate for resiliently mounting said grinding wheel.

5. A machine as defined in claim 4, wherein the means for attaching said bearing means to said chassis comprises a pivotable linkage having a pair of parallel links between said bearing means and said chassis.

6. A machine as defined in claim 4, wherein said means for supporting weights on said tool comprises a weight support frame supported by said bearing means and arranged to support at least one weight fitted over said rotational shaft to adjust the effective grinding wheel pressure on the flat surface as desired.

7. A machine as defined in claim 6, comprising means connected to said chassis for selectively raising said grinding wheel from said floor for supporting said grinding wheel on said chassis.

8. A machine as defined in claim 7, wherein said means for raising said grinding wheel comprises lever means pivotally mounted to said chassis for engaging one of said weight support frame, said bearing means, and said grinding head for selectively raising said grinding wheel.

9. A machine as defined in claim 8, wherein said chassis includes a vertical steering shaft and one of said wheels is attached to said steering shaft, and wherein said lever means comprises a lever pivotably mounted to said chassis for engaging said weight support frame for selectively raising and lowering said bearing means, and a lever actuating linkage comprising a tube disposed about said steering shaft for movement vertically relative to said steering shaft, a connector link attached between said tube and said lever, and cam means connected between said chassis and said tube for moving said tube vertically relative to said steering shaft for raising and lowering said grinding wheel.

10. A machine as defined in claim 1, comprising vacuum cleaning means for removing grinding dust generated by said grinding wheel, said vacuum cleaning means including a cover attached to said bearing means for fitted over said tool to contain dust, said cover having an opening for removing dust, a vacuum cleaner unit mounted on said chassis, and duct means communicating between said cover opening and said unit.

11. A machine for finishing a substantially horizontal surface, for example a floor made of cement, concrete, or similar hardened material, comprising:

(a) a chassis;

(b) a grinding tool;

(c) means for mounting said tool to said chassis for rotation about a vertical rotational axis, for constraining horizontal movement of said tool relative to said chassis, and for permitting vertical movement of said tool relative to said chassis;

(d) drive means for rotating said tool about said rotational axis;

(e) means for supporting weights on said tool for adjusting the downward pressure of said tool against said surface independent of said chassis; and (f) means for supporting said chassis on said flat surface for absorbing torque produced by the rotation of said tool comprising at least three wheels arranged to carry the weight of said chassis, and means for maintaining two of said wheels parallel to each other.

12. A machine as defined in claim 11, wherein said rotational axis extends through a longitudinal axis of said machine, wherein said two wheels are arranged laterally spaced apart relative to said longitudinal axis, and wherein said two wheels and the third wheel are longitudinally disposed on opposite sides of said rotational axis.

13. A machine as defined in claim 12, wherein said two wheels are fixed about vertical axes, and comprising steering means coupled to said third wheel for pivoting said third wheel about a vertical axis for steering said machine.

* * * * *